United States Patent [19]

Nishikawa

[11] 4,338,017

[45] Jul. 6, 1982

[54] ELECTROPHOTOGRAPHIC APPARATUS

[75] Inventor: Masaji Nishikawa, Hachioji, Japan

[73] Assignee: Olympus Optical Company Limited, Tokyo, Japan

[21] Appl. No.: 223,692

[22] Filed: Jan. 9, 1981

[30] Foreign Application Priority Data

Feb. 7, 1980 [JP] Japan ..... 55/13063

[51] Int. Cl.[3] ..... G03G 15/00

[52] U.S. Cl. ..... 355/3 TR; 430/126

[58] Field of Search ..... 355/3 TR, 3 R, 77; 430/126; 427/25

[56] References Cited

U.S. PATENT DOCUMENTS

| | | | |
|---|---|---|---|
| 3,781,105 | 12/1973 | Meagher | 355/3 TR |
| 3,832,053 | 8/1974 | Goel et al. | 355/3 TR |
| 3,837,741 | 9/1974 | Spencer | 355/3 TR |
| 3,877,416 | 4/1975 | Donohue et al. | 355/3 TR |
| 3,879,121 | 4/1975 | Simpson | 355/3 TR |
| 4,055,380 | 10/1977 | Borostyan | 355/3 TR |
| 4,134,147 | 1/1979 | Watanabe | 355/3 TR |
| 4,220,699 | 9/1980 | Ishida et al. | 355/3 TR |

*Primary Examiner*—R. L. Moses

*Attorney, Agent, or Firm*—Fleit & Jacobson

[57] ABSTRACT

An electrophotographic apparatus comprising a photosensitive drum applied with a main transfer bias voltage which is adjustable and a transfer roller applied with an auxiliary transfer bias voltage which is also adjustable.

3 Claims, 7 Drawing Figures

ELECTROPHOTOGRAPHIC APPARATUS

BACKGROUND OF THE INVENTION

1. Field of the Invention

This invention relates to an electrophotographic apparatus comprising an electric charge holding member supported by at least an electrically conductive body, a developing device for developing an electrostatic latent image produced on said electric charge holding member into a visible image, a transfer device including a transfer roller arranged in contact with the electric charge holding member, and an image receiving paper feed means for feeding an image receiving paper through a toner image transfer portion where said electric charge holding member makes contact with the transfer roller and operative to repeat developing and transfer steps with respect to the electrostatic latent image once produced on the electric charge holding member to form the same picture image on a plurality of image receiving papers.

2. Description of the Prior Art

Such conventional electrophotographic apparatus has the disadvantage that when the apparatus operates under a high humid condition or use is made of an image receiving paper whose resistance value is low due to its humid absorption property or the like, the transfer efficiency of the toner image becomes considerably low, and as a result, it is impossible to obtain a good picture image copy. In order to eliminate such drawback, another electrophotographic apparatus has been proposed which is constructed such that a bias voltage having a polarity which is the same as that of a bias voltage applied to the transfer roller is applied to an image receiving paper guide located near the transfer roller. But, such conventional electrophotographic apparatus has a number of disadvantages. In the first place, in order to always bring the image receiving paper into contact with the guides and transfer roller which are applied with the bias voltage, the bias voltage must be applied to these guide and roller widely distant apart from each other and these guide and roller must be insulated from the apparatus main body which is applied with ground potential, and as a result, the apparatus is complex in construction. Secondly, if the members applied with the bias voltage are located near the toner transfer portions, more or less deviation of the image receiving paper from a predetermined feed path results in a band-shaped or island-shaped picture image copy which is irregular in concentration. Third, if the image receiving path is made narrow in width in order to improve contact between the guides applied with the bias voltage and the image receiving paper, the image receiving path becomes jammed with the image receiving paper. Finally, if the resistance value of the image receiving paper is lowered, an electric charge is injected from the transfer roller and image receiving paper feed path member applied with the bias voltage through the image receiving paper having low resistance value into the photosensitive drum, thereby inducing fog on the non-picture image portion of the image receiving paper at each transfer step in the case of obtaining a plurality of copies.

SUMMARY OF THE INVENTION

An object of the invention, therefore, is to provide an electrophotographic apparatus which can eliminate the above mentioned drawbacks which have been encountered with the prior art techniques, which is simple in construction and which can obtain a plurality of picture image copies each having a uniform concentration from the same electrostatic latent image even when the resistance value of an image receiving paper is lowered due to its humid absorption property or the like.

A feature of the invention is the provision in an electrophotographic apparatus comprising an electric charge holding member supported by at least an electrically conductive body, a developing device for developing an electrostatic latent image produced on said electric charge holding member into a visible image, a transfer device including a transfer roller arranged in contact with said electric charge holding member, and an image receiving paper feed means for feeding the image receiving paper through a toner image transfer portion where said electric charge holding member makes contact with said transfer roller, and operative to repeat developing and transfer steps with respect to the electrostatic latent image once produced on said electric charge holding member to form the same picture image on a plurality of image receiving papers, of the improvement comprising a main transfer bias electric source connected between said electrically conductive body and ground and having a terminal for applying a bias voltage having a plurality which is the same as a toner charging polarity to said electrically conductive body, an auxiliary transfer bias electric source connected between said transfer roller and ground and having a terminal for applying a bias voltage having a polarity which is opposite to the toner charging polarity, and an image receiving paper feed path member for constituting said image receiving paper feed means, at least one portion of said image receiving paper feed path member being connected to ground, whereby said transfer bias voltage is automatically lowered when the resistance value of said image receiving paper is decreased due to its humid absorption property under a high humid condition or the like so as to prevent an undesirous electric charge from injecting onto a non-picture image portion of said electrostatic latent image.

Further objects and features of the invention will be fully understood from the following detailed description with reference to the accompanying drawings, wherein:

DETAILED DESCRIPTION OF THE PREFERRED EMBODIMENTS

Figure 1:
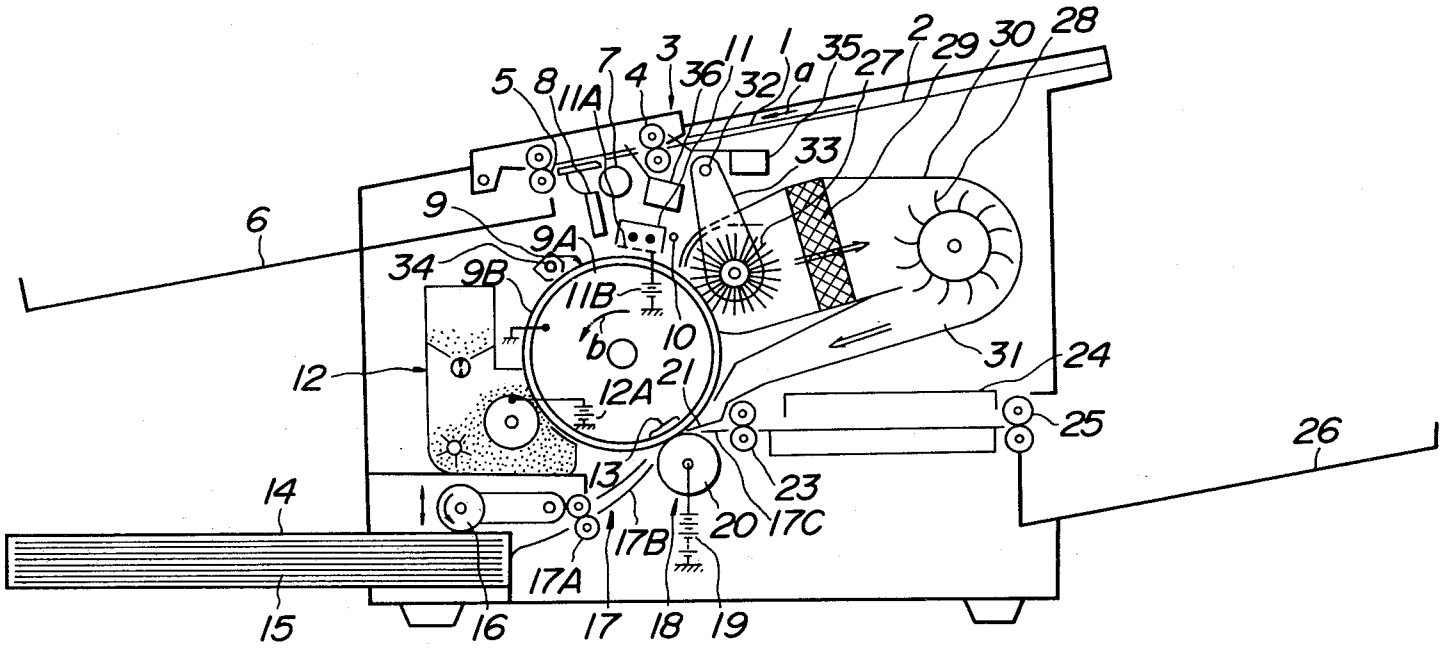
FIG. 1 PRIOR ART
FIG. 1 is a diagrammatic longitudinal sectional view of one example of a conventional electrophotographic apparatus.

FIG. 1 shows an example of a conventional electrophotographic apparatus. A sheet-shaped manuscript 1 disposed on a manuscript carriage 2 is inserted into a manuscript feed device 3 and fed by means of feed rollers 4, 5 into a manuscript tray 6. Between the feed rollers 4, 5, the manuscript 1 is illuminated by an illumination lamp 7 and a manuscript image is projected onto a rotary photosensitive drum 9 by means of an optical system 8. The photosensitive drum 9 is composed of a drum-shaped electrically conductive body 9A applied with a ground potential and a photoconductive layer 9B formed of Se, for example, and coated on the surface of the electrically conductive body 9A. The photoconductive layer 9B functions to hold electric charge on the surface of the electrically conductive body 9A. The photosensitive drum 9 is rotated in a direction shown by an arrow b and the electric charge thereon is erased by an erasing lamp 10. Then, the photosensitive drum 9 is uniformly charged by a corona discharge device 11 and then is illuminated with the manuscript image to produce on the electrically conductive layer 9B an electrostatic latent image. The corona discharge device 11 is composed of scorotron whose grid 11A is connected to a bias electric source 11B and applied with a voltage which is substantially equal to the charging potential of the photosensitive drum 9. The electrostatic latent image produced on the photosensitive drum 9 is subjected to toner development by a dry two component developing device 12 and then fed to a toner image transfer portion 13 as the photosensitive drum 9 is rotated. To the developing device 12 is connected a development bias electric source 12A. Image receiving papers 15 stacked in an image receiving paper cassette 14 are taken out of the cassette 14 one by one by a rocking and rotatable pick-up roller 16. The image receiving paper 15 is fed through an image receiving paper feed member 17 composed of rollers 17A and a guide 17B to the toner image transfer portion 13 with a given timing. At the toner image transfer portion 13, the image receiving paper is brought into contact with the photosensitive drum 9 and disposed on the toner image. A transfer device 18 functions to transfer the toner image from the photosensitive drum 9 to the image receiving paper. As the transfer device 18, use may be made of a bias roller transfer device composed of a semi-conductive transfer roller 20 connected through a transfer bias electric source 19 to ground. The transfer roller 20 is generally brought into contact with the photosensitive drum 9 for the purpose of effectively maintaining the electrostatic latent image on the photosensitive drum 9 during operation of obtaining a plurality of copies. The image receiving paper delivered from the toner image transfer portion 13 and closely adhered to the photosensitive drum 9 is separated from the photosensitive drum 9 by a scraper claw 21 and an air stream to be described later. The image receiving paper is then fed along a guide 17C constituting one member of the image receiving sheet guide 17 to feed rollers 23. The feed rollers 23 function to feed the image receiving paper into a heat fixing device 24 provided therein with a heater. In the heat fixing device 24, the toner image is fixed and then the image receiving paper is delivered from outlet rollers 25 into a copy tray 26. The rollers 17A, guides 17B, 17C, scraper claw 21 and feed rollers 23 of the image receiving paper feed path member 17 are generally applied with ground potential. The toner image on the photosensitive drum 9 is not completely transferred to the image receiving paper, but a portion of the toner image is remained thereon. The residual toner is erased from the surface of the photosensitive drum 9 by a rotary cleaner brush 27. The toner erased from the surface of the photosensitive drum 9 is sucked into an air stream produced by rotation of a fan 28 and collected into a filter 29. The cleaner brush 27 and fan 28 are surrounded by a housing 30 in order to obtain an effective suction force and prevent the toner from scattering in the apparatus. The exhaust air delivered from the fan 28 is fed through a duct 31 into an exit opening terminated at the toner image transfer portion 13, thereby effectively separating the image receiving paper from the photosensitive drum 9 with the aid of the scraper claw 21. The cleaner brush 27 is rotatably journaled in one end portion of an arm 33, the other end of which being rotatably mounted on a supporting shaft 32. The cleaner brush 27 is separated from the photosensitive drum 9 when the electrostatic latent image produced once on the photosensitive drum 9 is repeatedly used to repeat the toner development and transfer so as to transfer the toner image to a plurality of image receiving papers in succession and hence obtain a plurality of copies. Between the optical image projection position and the development position is arranged a trimming lamp 34 which is located near the periphery of the photosensitive drum 9 so as to erase the electric charge at a blind area of the photosensitive drum 9 which does not correspond to the image receiving paper 15. The operation of the above mentioned constitutional elements of the electrophotographic apparatus is controlled by switches 35, 36 which can detect the manuscript position.

The above mentioned conventional electrophotographic apparatus has the disadvantage that when the electrophotographic apparatus is operated under a high humid condition or use is made of an image receiving paper whose resistance value becomes decreased due to its humid absorption property or the like, the transfer efficiency of the toner image is considerably degraded, and as a result, it is impossible to obtain a good picture image copy. That is, if the image receiving paper decreases its resistance value due to causes such as its humid absorption property or the like, current flows through the image receiving paper into the guide path member 17 arranged near the toner image transfer portion 13 and applied with the ground potential. As a result, a voltage drop is produced due to resistance of the semiconductive transfer roller 20 to decrease the transfer voltage, thereby preventing a proper transfer.

Figure 2:
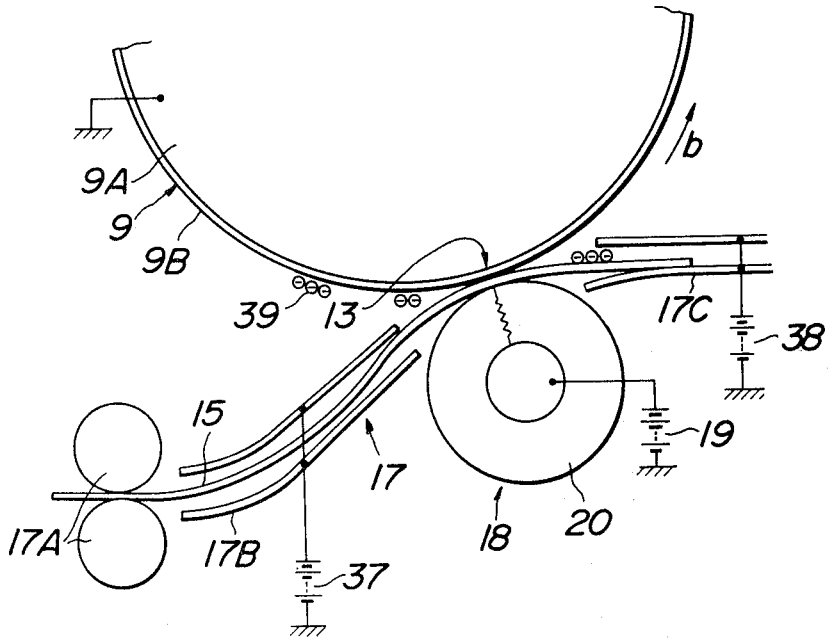
FIG. 2 PRIOR ART
FIG. 2 is an enlarged cross-sectional view of essential parts of another example of a conventional electrophotographic apparatus.

FIG. 2 shows an image receiving paper feed path member 17 which has heretofore been proposed for the purpose of eliminating the above mentioned drawback. In this device, a guide 17B arranged near the transfer roller 20 (or a transfer corona discharge device) of the image receiving paper feed path member 17 is connected through a direct current source 37 to ground and a guide 17C of the same member 17 is connected through a direct current source 38 to ground so as to apply the guides 17B, 17C with a bias voltage having a polarity which is opposite to the polarity of a toner charging polarity 39, that is, with a bias voltage having a polarity which is the same as the polarity of the transfer bias voltage. The use of such measure ensures a suppression of an undesirous electric current flow through the image receiving paper 15 having a low resistance value even when the resistance of the image receiving paper 15 is decreased due to causes such as its humid absorption property or the like since the guides 17B, 17C located near the toner image transfer portion 13 are applied with the bias voltage which is the same in polarity as the transfer bias voltage, whereby a proper transfer voltage is maintained at the toner transfer portion 13 to effect a good transfer.

But, in order to always bring the image receiving paper 15 into contact with the guides 17B, 17C and transfer roller 20 which are applied with the bias voltage, the bias voltage must be applied to each of these members which are distant apart from each other. As a result, each of the above mentioned members must be insulated from the apparatus main body applied with ground potential. Thus, the apparatus becomes complex in construction. In practice, if the members applied with the bias voltage are located near the toner image transfer portion 13 for the purpose of simplifying the construction of the apparatus, a band-shaped or island-shaped fog are produced on the image receiving paper, when the travelling course of the image receiving paper is somewhat deviated from a predetermined path. If the image receiving paper feed path is made narrow in width such that a good contact is established between the guides 17B, 17C applied with the bias voltage and the image receiving paper, it is proved by experience that the image receiving paper feed path is jammed with the image receiving paper. In addition, if the resistance value of the image receiving paper is decreased, an electric charge is injected from the image receiving paper guide member 17 applied with the bias voltage inclusive of the transfer roller 20 through the image receiving paper 15 having a low resistance value into the photosensitive drum 9. As a result, in the case of obtaining a plurality of copies from the same electrostatic latent image produced on the photosensitive drum 9, fog is induced on the non-picture image portion of the copy everytime the transfer step is effected.

Figure 3:
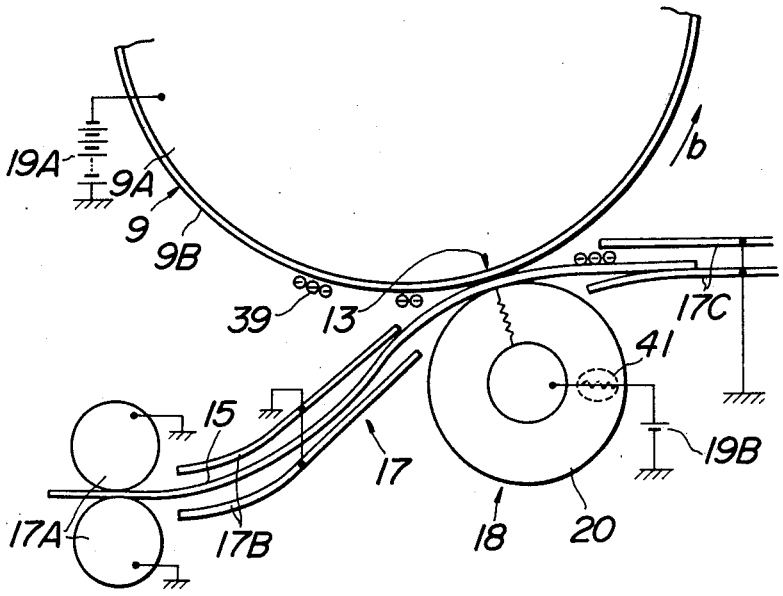
FIG. 3 is an enlarged cross-sectional view of essential parts of one embodiment of an electrophotographic apparatus according to the invention.

FIG. 3 shows essential parts of one embodiment of an electrophotographic apparatus according to the invention. In the present embodiment, if the resistance value of the image receiving paper is high under a low humid condition, a high transfer voltage is generated at the toner image transfer portion 13. If the resistance value of the image receiving paper becomes low under a high humid condition, the voltage at the toner image transfer portion 13 is automatically lowered such that a proper transfer voltage can be applied to the image receiving paper 15 even under such high humid condition. For this purpose, the electrically conductive body 9A of the photosensitive drum 9 is connected through a transfer bias electric source 19A to ground so as to apply to the electrically conductive body 9A a main transfer bias voltage whose polarity is the same as the charging polarity of the toner 39. In order to change the transfer bias voltage from time under the high humid condition to time under the low humid condition so as to obtain a desirous transfer voltage, the transfer roller 20 is connected through an auxiliary transfer bias electric source 19B to ground. As a result, it is possible to apply to the transfer roller 20 an auxiliary transfer bias voltage which corresponds to difference between the transfer voltage produced at the time under the high humid condition and the transfer voltage produced at the time under the low humid condition and which is opposite in polarity to the charging polarity of the toner 39. In addition, the rollers 17A and guide 17B, 17C located near the toner image transfer portion 13 and constituting the image receiving guide path member 17 are connected to ground, respectively. In this way, when the resistance value of the image receiving paper 15 is high under the low humid condition, the current flowing through the image receiving paper 15 into the grounded members 17A, 17B, 17C is negligibly small. As a result, the transfer voltage applied to the toner transfer portion 13 becomes the sum of the main transfer bias voltage applied to the electrically conductive body 9A of the photosensitive drum 9 and the auxiliary transfer bias voltage applied to the transfer roller 20. On the contrary, if the image receiving paper 15 becomes humid under a high humid condition, the resistance value of the image receiving paper 15 becomes considerably lowered. As a result, a current flows through the image receiving paper 15 toward the grounded members 17A, 17B, 17C to produce a voltage drop in a semiconductor cover of the transfer roller 20, so that the surface potential of the transfer roller 20 becomes substantially equal to the grounded potential. That is, the transfer voltage applied to the toner image transfer portion 13 is the same of the main transfer bias voltage applied to the electrically conductive body 9A of the photosensitive drum 9 and the auxiliary transfer bias voltage applied to the transfer roller 20 under the low humid condition, but under the high humid condition the voltage drop is produced with respect to the auxiliary transfer bias voltage applied to the transfer roller 20. As a result, if the value of the auxiliary transfer bias voltage applied to the transfer roller 20 is made equal to the difference between a proper transfer voltage under the low humid condition and a proper transfer voltage under the high humid condition, it is possible to always obtain the optimum transfer voltage in correspondence with the change of the resistance value of the image receiving paper 15 in the case of obtaining a plurality of copies.

As can be seen from the above, in the electrophotographic apparatus comprising the photosensitive drum applied with the main transfer bias voltage according to the invention, the transfer roller is also applied with the auxiliary transfer bias voltage.

The use of such measure ensures a generation of a high transfer bias voltage which is the sum of the photosensitive drum bias voltage and the transfer roller bias voltage under the low humid condition, thereby improving the transfer efficiency.

Figure 4:
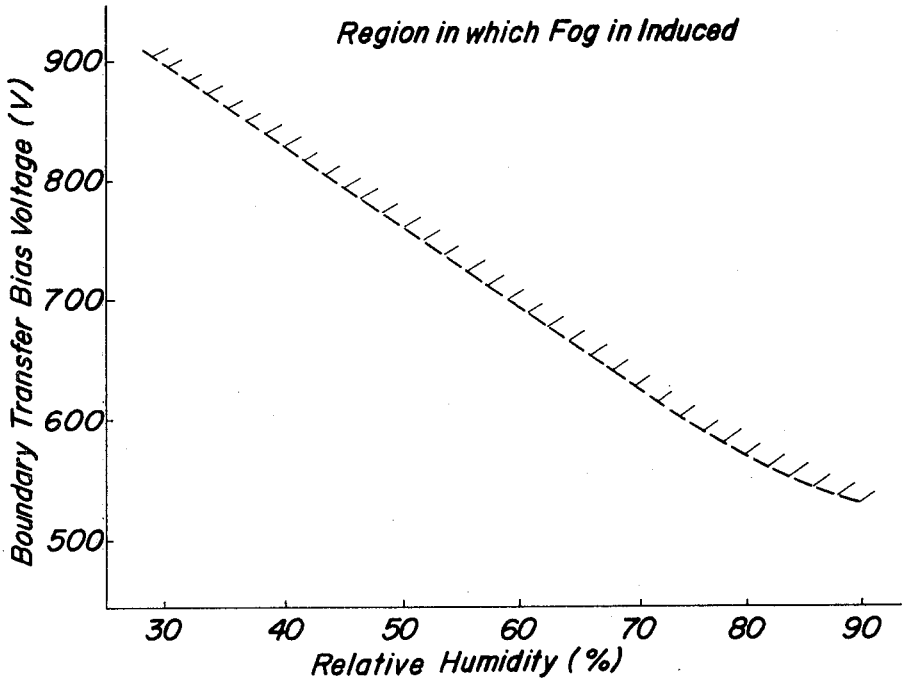
FIG. 4 is a graph illustrating a relation between a boundary transfer bias voltage (v) and a relative humidity (%)

FIG. 4 shows a graph illustrating a relation between a boundary transfer bias voltage (v) and a relative humidity (%). A region in which fog is induced on the non-picture image portion of a copy when a plurality of copies are preparing is shown by hatched lines in FIG. 4.

If both the photosensitive drum and the transfer roller are applied with the bias voltages which are higher than 700 v under the high humid condition, the transfer bias voltage becomes too high, thereby inducing fog on the non-picture image portion of the copy as shown in FIG. 4.

In the electrophotographic apparatus according to the invention, under the high humid condition, the auxiliary bias voltage applied to the transfer roller is grounded through the paper 15 whose resistance value becomes low. As a result, the main transfer bias applied to the photosensitive drum is only applied between the paper and the drum so as to reduce the transfer bias voltage and hence prevent the generation of fog as shown in FIG. 4.

Concrete values of the bias voltages suitable for the main bias electric source 19A and auxiliary bias electric source 19B will now be described. The transfer bias voltages under the low and high humid conditions are determined such that the non-picture image portion of the copy is prevented from being subjected to fog in the case of obtaining a plurality of copies of the picture image from the same electrostatic latent image. These values of the transfer bias voltage become different in dependence with the material, constructions or the like of the transfer roller 20.

Experimental tests on a transfer roller 20 composed of a rubber roller having a length of 220 mm and including an electrically conductive layer having a length of 220 mm and made contact with the rubber roller have demonstrated the following result. When the rubber roller was applied with a voltage of 1,000 v, it showed a resistance value of $1\times10^7\Omega$ to $1\times10^9\Omega$, when use was made of an image receiving paper 15 composed of a conventional plain paper and subjected to a low humid condition under which humidity is 40% at a temperature of 20° C., a preferable transfer bias voltage value was on the order of 700 v to 1,000 v. The use of such transfer bias voltage range ensures an obtention of a plurality of copies of the picture image having a good quality. If the transfer bias voltage was higher than 1,000 v, fog was produced at the non-picture image portion of the copy as the number of copies to be obtained from the same electrostatic latent image was increased.

If the transfer bias voltage was lower than 700 v, the toner image was not efficiently transferred to the image receiving paper and hence it was impossible to obtain a copy of the picture image having a sufficiently high concentration.

On the contrary, when use was made of the same transfer roller 20 and an image receiving paper 15 composed of a conventional plain paper and subjected to a high humid condition under which humidity was 80% at a temperature of 28° C., a preferable transfer bias voltage value was on the order of 400 v to 700 v.

As can be seen from the above experimental test result, it is preferable to set the main transfer bias voltage value to be applied from the main transfer bias electric source 19A to the electrically conductive body 9A of the photosensitive drum 9 to a range of 400 v to 700 v and make the polarity thereof the same as the charging polarity of the toner 39. In addition, it is preferable to set the auxiliary transfer bias voltage value to be applied from the auxiliary transfer bias electric source 19B to the transfer roller 20 to a range of 100 v to 400 v and make the polarity thereof opposite to the charging polarity of the toner 39. The main and auxiliary transfer bias voltages may be set to any value within the above ranges.

The image receiving paper 15 has an intermediate resistance value so that the auxiliary transfer bias voltage to be applied to the transfer roller 20 must be adjusted to a proper value or irregular resistance value produced in the transfer roller 20 due to its manufacture error must be compensated. In such a case, it is efficient to connect an additional resistor 41 shown by dotted line in FIG. 3 and having a variable or fixed resistance value to the bias circuit of the transfer roller 20. It is experimentally found out that the additional resistor 41 has a resistance value within a range from several tens MΩ to several hundreds MΩ. This resistance value becomes different in dependence with the resistance value of the transfer roller 20 and to the contact pressure between the photosensitive drum 9 and the transfer roller 20 and hence is not always limited to the value within the above mentioned range.

In the embodiment shown in FIG. 3, the roller 17A and guides 17B, 17C of the image receiving paper feed path member are applied with ground potential. But, it is not necessary to apply a potential which is just the same as the ground potential to these roller and guides. A potential which is substantially the same as the ground potential may be applied to these roller and guides.

If one of these roller and guides is subjected to floating voltage, it is preferable to cause the image receiving paper 15 to travel while making contact with any one of the roller and guides.

Figure 5:
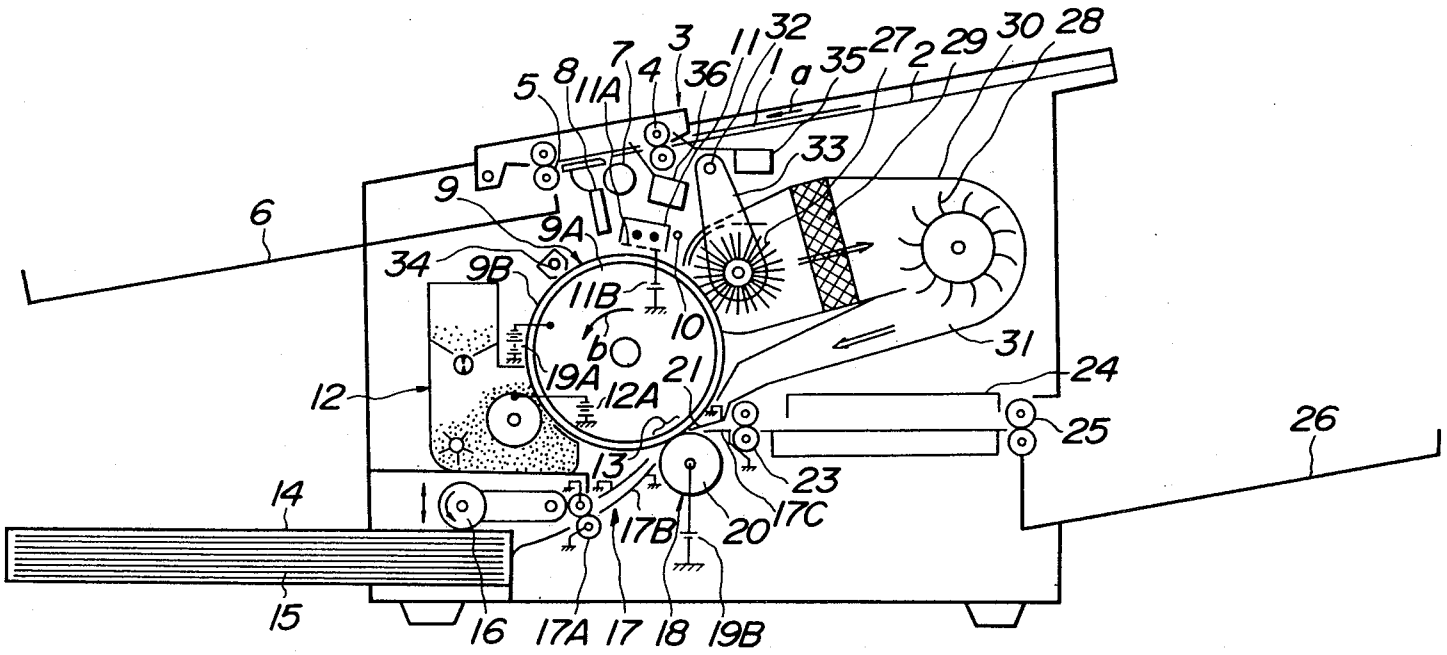
FIG. 5 is a diagrammatic longitudinal sectional view of an electrophotographic apparatus according to the invention to which is applied the embodiment shown in FIG. 3.

FIG. 5 shows an electrophotographic apparatus according to the invention to which is applied the embodiment shown in FIG. 3. Contrary to the conventional electrophotographic apparatus shown in FIG. 1, in the electrophotographic apparatus according to the invention shown in FIG. 5, the transfer bias electric source and image receiving paper travel path member are connected and arranged as shown in FIG. 3 and the bias electric source 11B to be connected to the grid 11A of the scorotron discharge device 11 and the development bias electric source 12A to be connected to the developing device 12 are made opposite in polarity and change in voltage value. In the embodiment shown in FIG. 5, each bias voltage is determined such that potential differences between the electrically conductive body 9A of the photosensitive drum 9 and devices associated therewith such as the grid 11A of the scorotron discharge device 11, developing device 12 or the like to which is applied the bias voltage in association with the electrically conductive body 9A of the photosensitive drum 9 is just the same as corresponding potential difference in the conventional electrophotographic apparatus shown in FIG. 1.

As stated hereinbefore with reference to FIG. 3, the electrophotographic apparatus according to the invention shown in FIG. 5 is capable of obtaining a plurality of excellent copies of a picture image which is uniform in concentration from the same electrostatic latent image even when the resistance value of the image receiving paper 15 is decreased due to the cause such as its humid absorption property or the like. In this case, however, if the transfer bias voltage is adjusted or changed in value for some reason, the potential difference between the grid 11A of the scorotron discharge device 11, developing device or the like and the electrically conductive body 9A of the photosensitive drum 9 becomes also changed. In order to restore such potential difference to the original value, it is necessary to adjust the voltage of the bias electric sources 11B, 12A or the like.

Figure 6:
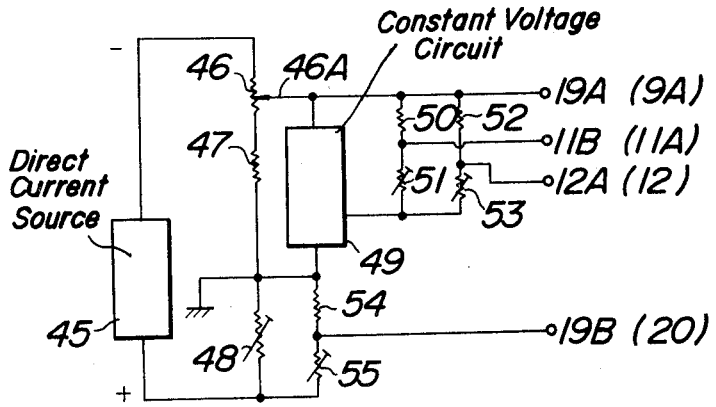
FIG. 6 is a circuit diagram of one example of a bias electric source circuit which is suitably used for an electrophotographic apparatus according to the invention.

FIG. 6 shows a bias electric source circuit which can satisfy the requirements of the apparatus shown in FIG. 5. The bias electric source circuit shown in FIG. 6 is connected and arranged such that a single direct current source functions to supply a direct current to a resistance type voltage divider circuit and a constant voltage circuit so as to obtain various kinds of bias voltages inclusive of voltages which are positive or negative with respect to ground potential and that even when the main transfer bias voltage applied to the electrically conductive body of the photosensitive drum is changed, the potential difference between the electrically conductive body and any other member applied with the bias voltage is not substantially changed. In FIG. 6, reference numeral 45 designates a direct current source whose voltage is divided by means of a variable resistor 46, fixed resistor 47 and variable resistor 48. A junction point between the resistors 47 and 48 is connected to ground. As a result, as viewed from the ground potential, a negative potential is produced at the side of the resistor 46, while a positive potential is produced at the side of the resistor 48. A slide tap 46A of the variable resistor 46 functions as the main transfer bias electric source 19A and an output voltage thereof is delivered to the electrically conductive body 9A of the photosensitive drum 9. As a result, it is possible to change the main transfer bias voltage by slidably moving the slide tap 46A. Between the slide tap 46A and ground is connected a constant voltage circuit 49 to which is applied the main transfer bias voltage from the variable resistor 46. The constant voltage output delivered from the constant voltage circuit 49 is divided by a fixed resistor 50 and variable resistor 51. An output voltage delivered from a junction point between the resistors 50, 51 is applied as the bias electric source 11B to the scorotron grid 11A. This output voltage applied to the scorotron grid 11A can be changed in value by adjusting the variable resistor 51. In addition, the constant voltage output delivered from the constant voltage circuit 49 is divided by a fixed resistor 52 and variable resistor 53. An output voltage delivered from a junction between the resistors 52, 53 is applied as the development bias electric source 12A to the developing device 12. This output voltage applied to the developing device 12 can be changed by adjusting the variable resistor 53.

Meanwhile, across the variable resistor 48 is connected a fixed resistor 54 and a variable resistor 55. An output voltage delivered from the junction point between the resistors 54, 55 is applied as the auxiliary transfer bias electric source 19B to the transfer roller 20. The output voltage applied to the transfer roller 20 can be changed by adjusting the variable resistor 5 independently of the other bias voltages.

In the bias electric source circuit shown in FIG. 6, if the position of the slide tap 46A of the resistor 46 is changed, the output voltage thereof, i.e. the main transfer bias electric source 19A becomes changed. In this case, the constant voltage circuit 49 is operative on the basis of the output voltage from the slide tap 46A of the resistor 46. The output voltage delivered from the constant voltage circuit 49 is automatically changed with respect to the ground potential in the same amount as the change of the output voltage from the slide tap 46A of the resistor 46. As a result, no change occurs in the differences between the voltage of the bias electric sources 11B, 12A obtained by dividing the output voltage delivered from the constant voltage circuit 49 and the voltage of the main transfer bias electric source 19A which is the reference potential. In addition, it is possible to adjust the voltage value of the auxiliary transfer bias electric source 19B by adjusting the variable resistor 55 independently of the adjustment of the other bias voltages. As a result, the voltage of each bias electric source can be adjusted without exerting any influence upon the set value of any other bias electric source. Thus, it is possible to effect a so-called single adjustment. Various changes of the resistance type voltage divider circuit, constant voltage circuit or the like may be possible. For example, the resistance type voltage divider circuit of the auxiliary transfer bias electric source 19B may be composed of a variable resistor 48 provided with a slide tap. In addition, the constant voltage circuit 49 may be composed of a zener diode, discharge tube and transistor or any other conventional circuit.

Figure 7:
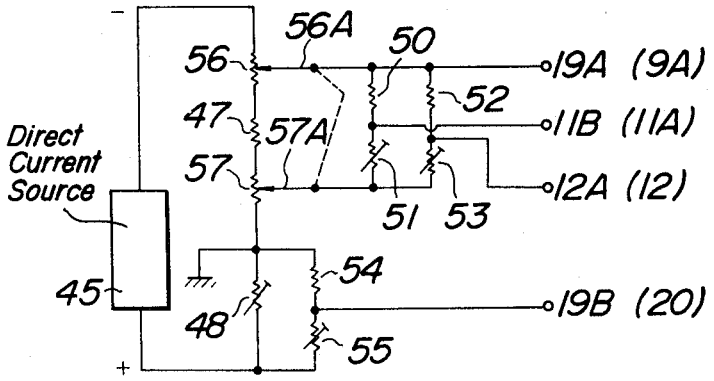
FIG. 7 is a circuit diagram of another example of a bias electric source circuit which is suitably used for an electrophotographic apparatus according to the invention.

FIG. 7 shows another bias electric source circuit which does not make use of the constant voltage circuit shown in FIG. 6, but makes use of variable resistors 56, 57 connected in series across the direct current source 45 and having same resistance value, the variable resistors 56, 57 being provided with slide taps, respectively. A voltage divider circuit composed of the series connected resistors 56, 47, 57, 48 is designed such that its resistance value is smaller than that of the other resistors. As a result, a relatively large idling current flows the series connected resistors. This large idling current is not so much changed due to current flowing into and from each of the bias electric sources 11B, 12A, 19A, 19B. In addition, the slide taps 56A, 57A are interlocked with each other. The resistance value between the slide taps 56A, 57A is the sum of portions of the resistance values of the resistors 56, 57 and the resistance value of the resistor 47. If this sum of these resistance values is made always constant, the voltage between the taps 56A, 57A is always kept constant since the current flowing the current from the resistor 56 to the resistor 48 is substantially constant. The constant voltage circuit shown in FIG. 7 is simple in construction and can effectively be applied to the electrophotographic apparatus according to the invention.

As stated hereinbefore, the present invention is capable of providing an electrophotographic apparatus which can obtain a plurality of picture image copies by repeating developing and transfer steps with respect to an electrostatic latent image once produced on a charge holding member and in which a main transfer bias voltage is applied to an electrically conductive body for supporting a charge holding member, an auxiliary transfer bias voltage is applied to a transfer roller and grounded members are arranged along an image receiving paper feed path for the purpose of efficiently transferring a toner image to the image receiving paper which has lowered its resistance value under a high humid condition, whereby a proper transfer bias voltage is always maintained at the transfer portion both under the high humid condition and under a low humid condition.

What is claimed is:

1. In an electrophotographic apparatus comprising an electric charge holding member supported by at least an electrically conductive body, a developing device for developing an electrostatic latent image produced on said electric charge holding member into a visible image, a transfer device including a transfer roller arranged in contact with said electric charge holding member, and an image receiving paper feed means for feeding the image receiving paper through a toner image transfer portion where said electric charge holding member makes contact with said transfer roller, and operative to repeat developing and transfer steps with respect to the electrostatic latent image once produced on said electric charge holding member and to form the same picture image on a plurality of image receiving papers, the improvement comprising a main transfer bias electric source connected between said electrically conductive body and ground and having a terminal for applying a bias voltage having a polarity which is the same as a toner charging polarity to said electrically conductive body, an auxiliary transfer bias electric source connected between said transfer roller and ground and having a terminal for applying a bias voltage having a polarity which is opposite to the toner charging polarity, and an image receiving paper feed path member for constituting said image receiving paper feed means, at least one portion of said image receiving paper feed path member being connected to ground, whereby said transfer bias voltage is automatically lowered when the resistance value of said image receiving paper is decreased due to its humid absorption property under a high humid condition or the like so as to prevent an undesirous electric charge from injecting onto a non-picture image portion of said electrostatic latent image.

2. The apparatus according to claim 1, wherein said main transfer bias electric source is composed of a direct current source and a voltage divider circuit connected across said direct current source and including a variable resistor having a slidable tap connected to said electrically conductive body.

3. The apparatus according to claim 1, wherein said auxiliary transfer bias electric source is composed of a direct current source and a voltage divider circuit connected across said direct current source and including a variable resistor connected in parallel with series connected fixed and variable resistors whose common junction point is connected to said transfer roller.

* * * * *